US005180220A

United States Patent [19]

Van Kalsbeek

[11] Patent Number: 5,180,220

[45] Date of Patent: Jan. 19, 1993

[54] STITCHERY LIGHT-BASE AND CLAMP

[76] Inventor: Dorothy J. Van Kalsbeek, 25092 Via Las Lomas, Murrieta, Calif. 92362

[21] Appl. No.: 807,492

[22] Filed: Dec. 16, 1991

Related U.S. Application Data

[63] Continuation-in-part of Ser. No. 588,533, Dec. 6, 1990, abandoned.

[51] Int. Cl.[5] ..... F21L 15/20

[52] U.S. Cl. ..... 362/98; 362/253; 362/396

[58] Field of Search ..... 362/98, 396, 253, 287, 362/418, 419, 427, 157, 191

[56] References Cited

U.S. PATENT DOCUMENTS

| | | | |
|---|---|---|---|
| 1,847,051 | 2/1932 | Zabach . | |
| 4,432,042 | 2/1984 | Zeller | 362/98 |
| 4,581,684 | 4/1986 | Mazzucco | 362/98 |
| 4,598,340 | 7/1986 | Dwosh et al. | 362/98 |
| 4,680,681 | 7/1987 | Fisherman et al. | 362/98 |
| 4,885,667 | 12/1989 | Selden | 362/396 |

FOREIGN PATENT DOCUMENTS 284368 4/1931 Italy .

*Primary Examiner*—Richard R. Cole
*Attorney, Agent, or Firm*—Loyal M. Hanson

[57] ABSTRACT

A stitchery light includes an arm for supporting a lamp and a base member for supporting the arm on a stitchery implement. The arm extends from a proximal end portion of the arm to a distal end portion, the arm includes a lamp socket on the distal end portion, and the proximal end portion of the arm is mounted pivotally on the base member. The base member includes a capsular component to which the arm is pivotally mounted, a downwardly extending bracket molded integrally with the capsular component in unitary one-piece construction, and a clamping member adjustably mounted on the bracket to work in opposition to the capsular component. The capsular component, the bracket, and the clamping member are arranged to adjustably mount on the stitchery implement so that with the stitchery implement in a horizontal position, the capsular component bears downwardly on the stitchery implement, the clamping member bears upwardly, and the arm extends upwardly where it can be pivoted to a desired position above the stitchery implement. The base member may be formed of an injection molded plastic material dimensioned and arranged to substitute for the base member of some existing miniature book lights.

8 Claims, 2 Drawing Sheets

STITCHERY LIGHT-BASE AND CLAMP

CROSS REFERENCE TO RELATED APPLICATION

This application is a continuation in part of U.S. patent application Ser. No. 07/588,533 filed Dec. 6, 1990 naming the same inventor now abandoned.

BACKGROUND OF THE INVENTION

1. Technical Field.

This invention relates generally to lighting fixtures, and more particularly to a small portable light that attaches to an embroidery hoop, stretcher-bar, needlework frame, or other such stitchery implement.

2. Background Information.

U.S. Pat. No. 4,432,042 to Zeller describes a portable light that mounts directly on a book. Fabricated of plastic in a small, lightweight configuration, the light includes a lamp-supporting tubular neck mounted pivotally on a capsular base. Two clamping members molded integrally with the base cooperate as a large paper clip to grip the pages or cover of a book. That enables the light to support itself on the book without adding appreciable weight so one can use it to read in bed with just a small cone of light.

But the paper-clip clamping arrangement does not work with a stitchery hoop. It fails to grip the hoop securely. Also, the clamping members occupy an interfering position over the workpiece. Nevertheless, the lightweight and delicate miniature appearance of the Zeller book light make a stitchery-hoop counterpart desirable.

The problem is that a suitable design for such a counterpart is not obvious. Furthermore, existing clamping arrangements, such as the one described in U.S. Pat. No. 4,885,667 to Selden, do not make it obvious. One could remove the goosenecks 18 and 20 from the Selden base member 10, somehow attach the Zeller tubular arm 4 in their place, and then clamp the Selden clamp member 12 to the stitchery hoop. But that results in a large, bulky, heavy, unwieldy, and relatively expensive arrangement that fails to retain the Zeller switching arrangement. Moreover, it detracts from the delicate miniature appearance.

Similarly, one could remove the stem 8 from the music stand light holder described in U.S. Pat. No. 1,847,051 to Zabach, and then somehow attach the Zeller tubular neck 4. But that is just as unworkable for basically the same reasons. Similarly, attaching the Zeller tubular arm 4 in place of the tube 4 in Italian Pat. No. 284368 to Perazzone does not work either. Thus, stitchery enthusiasts need a miniature light with a suitable clamping arrangement for stitchery hoops and other such implements.

SUMMARY OF THE INVENTION

This invention solves the problems outlined above by providing a stitchery light that may be configured similar to existing book lights in some respects. It is lightweight. It provides just a small cone of light. It clamps to a handheld object and presents a miniature appearance. The major difference: the clamping components remain out of the way along the edge of and beneath the stitchery implement.

Generally, a stitchery light constructed according to the invention includes a lamp-supporting arm and a base member. They may be similar in some respects to the book light described in U.S. Pat. No. 4,432,042. The arm extends from a proximal end of the arm to a distal end and it includes a lamp socket on the distal end. The proximal end mounts pivotally on the base member.

With the base member mounted on a stitchery implement, the distal end of the arm extends to an adjustable illuminating position above the workpiece. But significant differences in the base member specially adapt it for clamping to the stitchery implement. Instead of including a paper-clip-type clamp that overlies the center of the workpiece, the base member includes a downwardly extending clamping arrangement cleverly arranged to retain the desired attributes of existing book lights.

More specifically, the base member includes a capsular component to which the lamp-supporting arm is pivotally mounted. It also includes a generally flat downwardly extending bracket molded integrally with the capsular component in unitary one-piece construction. The bracket supports a manually adjustable, vertically slidable clamping member that works in opposition to the capsular component. The stitchery implement gets clamped in between.

The capsular component sits out of the way atop the stitchery hoop along the side of the workpiece. Meanwhile, the bracket and clamping member occupy positions alongside and underneath the stitchery implement. So, the stitchery light of this invention remains out of the way. Yet it remains and even significantly enhances the delicate miniature appearance desired. Moreover, it involves little remolding for manufacturers to adapt existing book light designs to stitchery implement use. Those and other objects, features, and advantages of the invention become more apparent upon reading the following detailed description with reference to the illustrative draiwngs.

DESCRIPTION OF THE PREFERRED EMBODIMENTS

Figure 1:
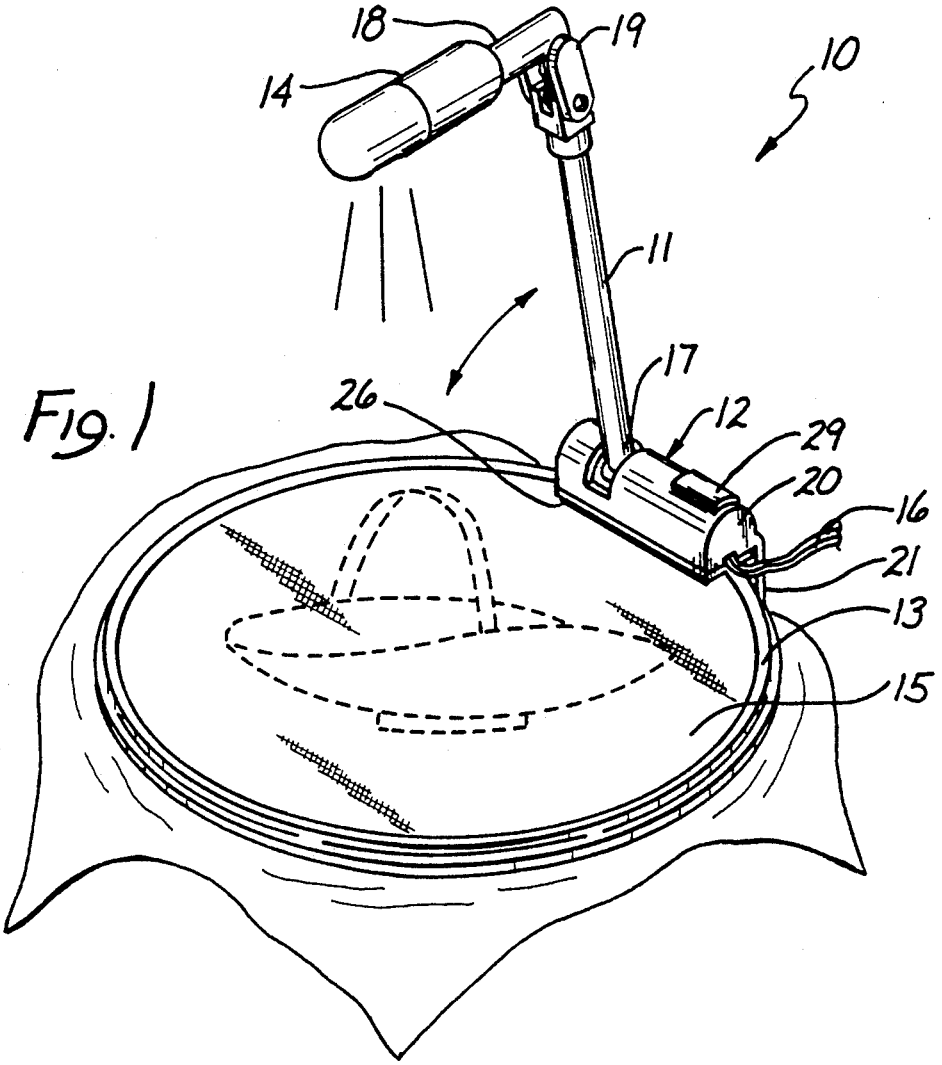
FIG. 1 of the drawings is a pictorial of a stitchery light constructed according to the invention-shown mounted on a conventional stitchery hoop with the lamp occupying an illuminating position above the workpiece.
Figure 5:
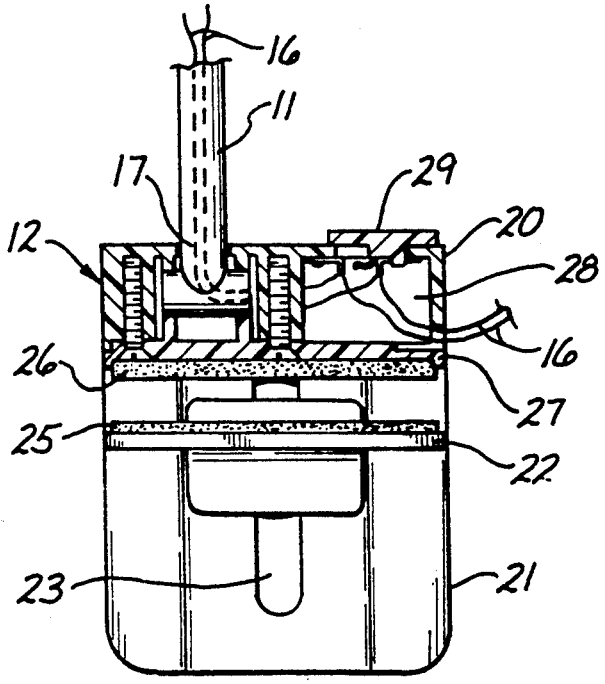
FIG. 5 is a front elevation view of the base member with portions in cross section to show the interior of the capsular component.

The drawings show a stitchery light 10 constructed according to the invention. Generally, it includes an arm 11 mounted pivotally on a base member 12. The base member 12 clamps on a conventional stitchery implement such as the illustrated embroidery hoop 13, while the arm 11 supports a lamp component 14 in an illuminating position above a workpiece 15 (e.g., a piece of fabric being embroidered). The lamp component 14 may include a low voltage lamp in a suitable socket connected by a cable 16 to a power source.

Figure 2:
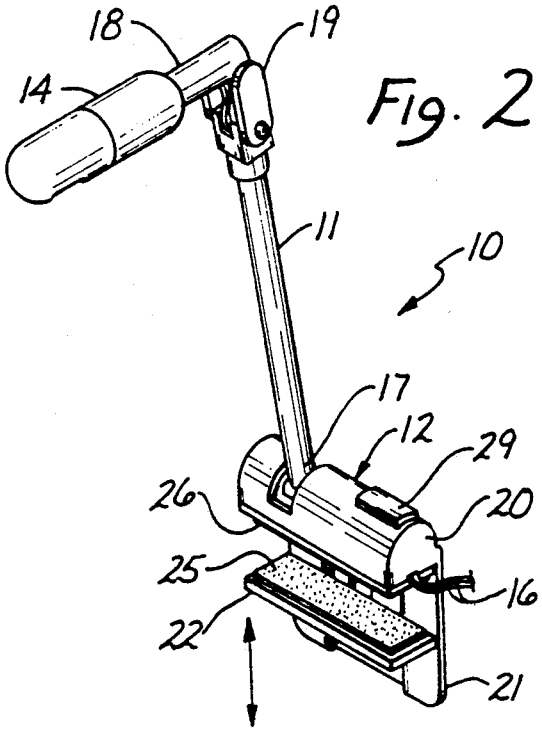
FIG. 2 is a pictorial view of just the stitchery light.
Figure 4:
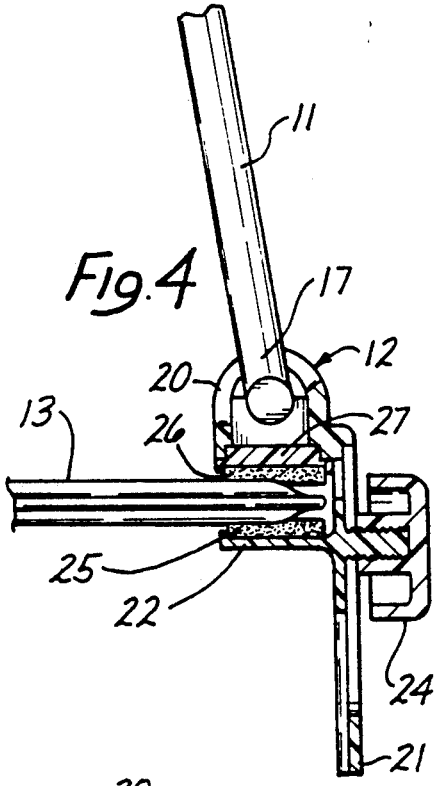
FIG. 4 is a side elevation view of the base member with portions in cross section to further illustrate the clamping arrangement-the workpiece being omitted for clarity.
Figure 3:
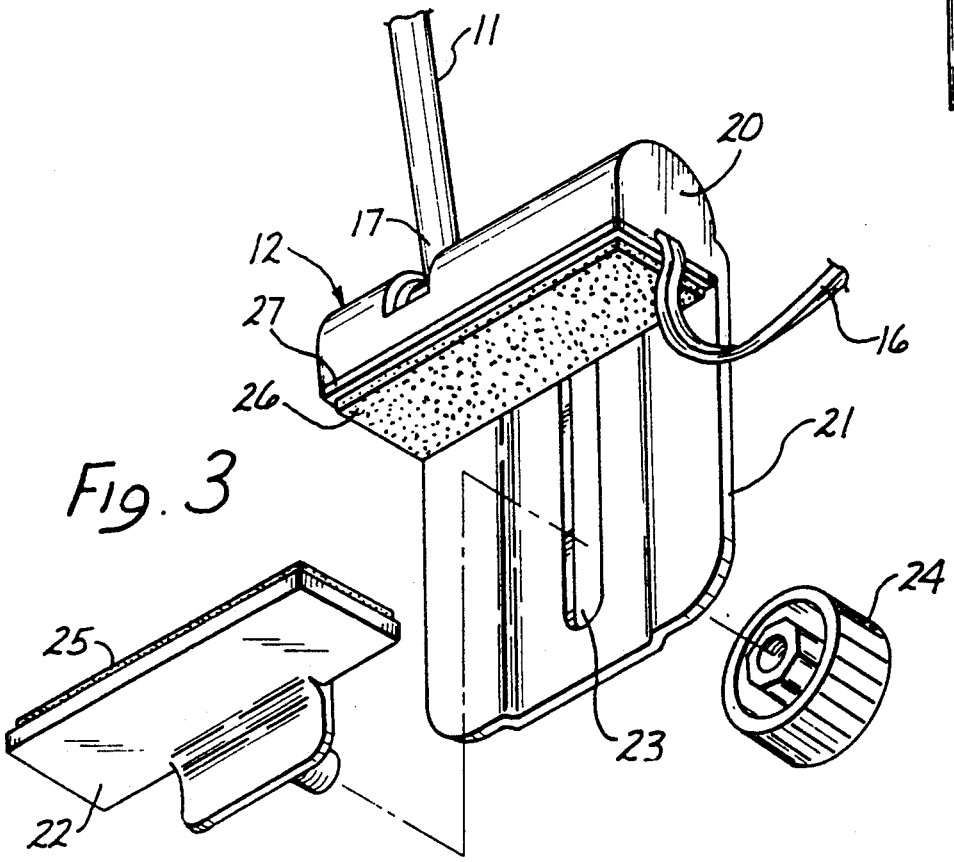
FIG. 3 is an enlarged pictorial view of the base member that shows the clamping member disassembled from the downwardly extending bracket.

The arm 11 extends from a proximal end portion 17 to a distal end portion 18 (FIGS. 1 and 2). The lamp component 14 is connected by suitable means to the distal end portion 18 while the proximal end portion 17 mounts pivotally on the base member 12. Suitable mounting means may be used to enable pivotal motion of the arm 11 relative to the base member 12, such as a cross member at the proximal end portion 17 of the arm 11 that is pivotally mounted in the structure of the base member 12. As a result, a user can pivot the arm 11 as depicted by the double-headed arrow in FIG. 1.

The arm may take the form of a plastic tube through which the cable 15 passes and include another pivotable joint 19 for increased adjustability. As an idea of size, the illustrated arm 11 measures about five inches between the joint 19 and the base member 12 and about three inches between the joint 19 and the furthermost end of the lamp component 14. Of course, those precise dimensions may vary considerably within the broader inventive concepts disclosed.

The base member 12 serves as means for supporting the arm 11 on the hoop 13. For that purpose, the base member 12 clamps to the hoop 13. With the base member 12 clamped to the hoop 13, the arm 11 extends upwardly where it can be pivoted to a desired illuminating position above the workpiece 15 as shown in FIG. 1. In that regard, the hoop 13 is generally used in a horizontal or slightly inclined position. So it is illustrated in a horizontal position. In other words, the plane of the hoop 13 lies in a horizontal plane as illustrated. Use of the words "upwardly," "downwardly," "vertical," "horizontal," "above," and "below" refer to that position and the corresponding position of the base member 12.

The base member 12 includes a capsular component 20 (FIGS. 1-5) to which the arm 11 is pivotally mounted. It also includes a downwardly extending bracket 21 (FIGS. 1-5) that is molded integrally with the capsular component 20 in unitary one-piece construction. Further, it includes a clamping member 22 (FIGS. 2-5) that is adjustably mounted on the bracket 21 to work in opposition to the capsular component 20.

The clamping member 22 slides vertically within a vertically extending slot 23 in the bracket 21 (FIGS. 3 and 5) as depicted by the double-headed arrow in FIG. 2. By manipulating a threaded-shaft-and-knob combination 24 (FIGS. 3 and 4) extending through the slot 23, the user adjusts the clamping member 22 so that the hoop 13 is clamped securely between the capsular component 20 and the clamping member 22. Pads 25 and 26 composed of a foam or other suitably flexible material add gripping strength while limiting scratching, marring, or other damage to the hoop 13.

A plate 27 (FIGS. 3-5) covers a downwardly opening hollow interior 28 of the capsular component 20. The hollow interior 28 serves as a passage for the cable 16. A slide switch component 29 (FIGS. 1, 2, and 5) is connected to the cable 16 to enable the user to switch the lamp component 14 on and off. The base member 12, as well as the arm 11, may be fabricated using an injection molded ABS plastic or glass-filled nylon material. As a further idea of size, the illustrated capsular component 20 measures about two inches long and the bracket 21 extends downwardly from the hoop 13 about two inches or so.

Thus, the invention provides a stitchery-light counterpart to existing miniature book lights. The capsular component sits out of the way atop the stitchery hoop along the side of the workpiece. Meanwhile, the bracket and clamping member occupy positions alongside and underneath the stitchery implement. So, the clamping arrangement remains out of the way. Yet it retains and even significantly enhances the delicate miniature appearance desired. Moreover, it involves little remolding for manufacturers to adapt existing book light designs to stitchery implement use.

Although an exemplary embodiment has been shown and described, many changes, modifications, and substitutions may be made by one having ordinary skill in the art without necessarily departing from the spirit and scope of the invention.

What is claimed is:

1. A stitchery light, comprising:

means in the form of an arm for supporting a lamp; and means in the form of a base member for supporting the arm on a stitchery implement so that with the stitchery implement disposed in a horizontal position, the arm extends upwardly where it can be pivoted to a desired position above the stitchery implement;

the arm extending from a proximal end portion of the arm to a distal end portion of the arm, and the arm including a lamp component on the distal end portion;

the base member including a capsular component to which the proximal end portion of the arm is pivotally mounted, means in the form of a switch on the capsular component for switching electrical current to the lamp component, a downwardly extending bracket molded integrally with the capsular component in unitary one-piece construction, and a clamping member adjustably mounted on the bracket to work in opposition to the capsular component;

the capsular component being shaped and dimensioned to set atop the stitchery implement without extending significantly radially inward or radially outward from the stitchery implement, the bracket being shaped and dimensioned to extend downwardly from the capsular component closely adjacent the stitchery implement, the bracket including a vertically elongated slot that extends horizontally through the bracket and the clamping member including means in the form of a threaded-shaft-and-knob combination extending horizontally through the vertically elongated slot for adjustably mounting the clamping member to the bracket;

the capsular component, the bracket, and the clamping member being arranged to adjustably mount on the stitchery implement so that with the stitchery implement in a horizontal position, the capsular component bears downwardly on the stitchery implement, the clamping member bears upwardly against the stitchery implement, the proximal end of the arm is disposed above the stitchery implement, and the bracket extends downwardly alongside and closely adjacent the stitchery implement.

2. A stitchery light as recited in claim 1, wherein the capsular component includes a hollow interior providing a passage for electrical wiring to the lamp component.

3. A stitchery light as recited in claim 1, wherein the capsular component has a downwardly opening hollow interior and the base member includes means in the form of a base plate on the capsular component for covering the hollow interior.

4. A stitchery light as recited in claim 1, wherein at least one of the capsular component and the clamping member include means in the form of a flexible pad for bearing against the stitchery implement in order to limit damage to the stitching implement.

5. A stitchery light as recited in claim 4, wherein the flexible pad is composed of a foam material.

6. A stitchery light as recited in claim 1, wherein the base member is composed of a plastic material.

7. A stitchery light as recited in claim 1, wherein the base member is composed of an injection molded ABS plastic material.

8. A stitchery light as recited in claim 1, wherein the base member is composed of an injection molded glass-filled nylon material.

* * * * *